US005810918A

United States Patent [19]

Landis

[11] Patent Number: 5,810,918

[45] Date of Patent: Sep. 22, 1998

[54] METHOD OF ANALYZING AND/OR TREATING FOUNDRY SANDS FOR REDUCED VOCS

[75] Inventor: Charles R. Landis, Lake in the Hills, Ill.

[73] Assignee: AMCOL International Corporation, Arlington Heights, Ill.

[21] Appl. No.: 851,948

[22] Filed: May 7, 1997

Related U.S. Application Data

[63] Continuation-in-part of Ser. No. 759,087, Nov. 29, 1996, Pat. No. 5,688,313, which is a continuation-in-part of Ser. No. 668,245, Jun. 21, 1996, Pat. No. 5,695,554.

[51] Int. Cl.[6] ..... B22C 1/00; B22C 9/00; B22C 9/02

[52] U.S. Cl. ..... 106/38.22; 164/4.1; 164/456; 164/47; 164/131; 164/138

[58] Field of Search ..... 106/38.22, 38.27, 106/38.28, 38.9; 164/131, 138, 456, 4.1, 47

[56] References Cited

U.S. PATENT DOCUMENTS

| | | | |
|---|---|---|---|
| 2,830,342 | 4/1958 | Meyers et al. | 22/193 |
| 2,830,913 | 4/1958 | Meyers et al. | 106/38.9 |
| 3,023,113 | 2/1962 | Barlow | 106/38.8 |
| 3,445,251 | 5/1969 | Nevins | 106/38.3 |
| 3,832,191 | 8/1974 | Bolding et al. | 106/38.3 |
| 3,938,578 | 2/1976 | Epstein et al. | 164/16 |
| 3,941,868 | 3/1976 | Riester | 423/210 |
| 4,002,722 | 1/1977 | Suzuki et al. | 423/238 |
| 4,034,794 | 7/1977 | Gebler et al. | 106/38.28 |
| 4,035,157 | 7/1977 | Riester | 23/277 C |
| 4,167,398 | 9/1979 | Hughes et al. | 44/17 |
| 4,505,750 | 3/1985 | Cowan | 106/38.35 |
| 4,615,712 | 10/1986 | Wen | 44/10 R |
| 4,946,647 | 8/1990 | Rohatgi et al. | 420/528 |
| 5,026,416 | 6/1991 | Alexander | 71/24 |
| 5,034,045 | 7/1991 | Alexander | 71/24 |
| 5,094,289 | 3/1992 | Gentry | 164/529 |
| 5,215,143 | 6/1993 | Gentry | 164/529 |
| 5,221,290 | 6/1993 | Dell | 44/554 |
| 5,275,114 | 1/1994 | Hughes | 106/38.3 |

FOREIGN PATENT DOCUMENTS

| | | |
|---|---|---|
| 843443 | 6/1970 | Canada . |
| 0 564 024 A1 | 10/1993 | European Pat. Off. . |
| 29 16 911 A1 | 10/1980 | Germany . |
| 51-045101 A | 4/1976 | Japan . |
| 374365 | 3/1970 | U.S.S.R. . |
| 1184908 | 3/1970 | United Kingdom . |

*Primary Examiner*—Michael Marcheschi
*Attorney, Agent, or Firm*—Marshall, O'Toole, Gerstein, Murray & Borun

[57] ABSTRACT

A method of maintaining foundry molding sand and/or a foundry core sand compositions relatively free of benzene and/or total quantity of volatile organic compounds (total VOCs) at 1800° F. and 1 atmosphere pressure by periodically analyzing the sand mold and/or sand core compositions for one or more aromatic hydrocarbons, such as benzene and/or other single ring aromatic hydrocarbons, such as toluene, and/or extractable organic matter (EOMs). If the sand composition is determined by analysis, e.g., by volatilizing the hydrocarbons and passing the volatilized material through a gas chromatograph, or by thermogravimetric analysis, to contain more than a desired amount of aromatic hydrocarbons, e.g., more than about 0.1 mg/g; and/or more than a desired amount of total VOCs, or extractable organic matter (EOM), e.g., more than about 0.5 mg/g total VOCs at 1800° F., the sand composition then can be treated by sand replacement; for hydrocarbon removal or hydrocarbon oxidation, such as by solvent extraction, or oxidation, e.g., by contact with $O_3$ in water solution; or by adding activated carbon or generating activated carbon in-situ with carbon, graphite acid as humic-containing ore. The treated sand then is reused to form a foundry sand mold and/or sand core for reduced emissions.

20 Claims, 2 Drawing Sheets

METHOD OF ANALYZING AND/OR TREATING FOUNDRY SANDS FOR REDUCED VOCS

CROSS-REFERENCE TO RELATED APPLICATIONS

This application is a continuation-in-part of U.S. application Ser. No. 08/759,087 filed Nov. 29, 1996 U.S. Pat. No. 5,688,313 which is a continuation-in-part of U.S. application Ser. No. 08/668,245 filed Jun. 21, 1996 U.S. Pat. No. 5,695,554.

FIELD OF THE INVENTION

The present invention is directed to a method of casting or molding metal objects by pouring molten metal against a foundry sand mold and/or foundry sand core and, more particularly, to a method of casting or molding metal objects against foundry sand molds and/or foundry sand cores and reusing the foundry sand to form molds and/or cores while reducing emissions of volatile organic compounds (VOCs) that accumulate via repeated sand use by treating the sand, e.g., by adding an activated carbon hydrocarbon absorber, or by periodically oxidizing or removing a majority of hydrocarbons that accumulate on the foundry sand.

BACKGROUND OF THE INVENTION AND PRIOR ART

Regular foundry sands are minerals dug from the ground or crushed from rock. Typical examples include silica sand, olivine sand, zircon sand and chromite sand. Silica sand accounts for approximately 90% of the sands used in the foundry industry. The other three sands are more thermally stable, but more expensive—zircon being the most thermally stable and most expensive.

Relatively inexpensive silica sand grains bound together with a suitable binder are used extensively as a mold and core material for receiving molten metal in the casting of metal parts. Olivine sand is much more expensive than silica sand but, having better thermal stability than silica sand, provides cast metal parts of higher quality, particularly having a more defect-free surface finish, requiring less manpower after casting to provide a consumer-acceptable surface finish. Olivine sand, therefore, has been used extensively as a mold and core surface in casting non-ferrous parts in particular and has replaced silica sand in many of the non-ferrous foundries in the United States.

Spherical or ovoid grain, carbon or coke particles, known to the trade as petroleum fluid coke, also have been used as foundry sands where silica sands and olivine sands do not have the physical properties entirely satisfactory for casting metals such as aluminum, copper, bronze, brass, iron and other metals and alloys. Such a fluid coke carbon sand presently is being sold by AMCOL International Corporation of Arlington Heights, Ill. under the trademark CAST-RITE® and has been demonstrated to be superior to silica sand and olivine sand for foundry sand.

Roasted carbon sands as described in U.S. Pat. Nos. 5,094,289 and 5,215,143 are carbon sands used for foundry molds and cores that are roasted to remove all of the volatile matter which would otherwise be evolved if raw fluid coke were exposed to molten metal.

Sand molds shape the outside of castings. Cores are sand shapes which are positioned inside the mold to shape the inside of a casting. If a core were not used, the casting would be solid metal and many castings are not solid, but have inside void configurations forming channels.

Molds are one of two kinds:

(1) "green" said molds are bentonite (clay)/water bonded sand mixtures or compositions rammed against a pattern to form a desired contour (a top half or cope and a bottom half or drag are booked together to form a complete mold cavity). The sand is a tough, pliable mixture which will hold its molded shape. Molten metal is poured into the mold cavity where it solidifies against the sand mixture to form the resultant casting.

(2) "rigid" molds are sand mixtures or compositions which can be molded against a pattern and then hardened into a rigid condition. The method of hardening depends on the kind of binder used. Although bentonite-bonded molds can be hardened by air-drying or baking, usually rigid molds are bonded with organic resins which harden into much stronger and harder shapes. Binders are designed to be hardened by several methods. Some are baked; some are cured or hardened by chemical reaction with a reagent; and some are hardened by flushing with a reactive gas.

Cores are usually rigid shapes employing many of the same kinds of binders and methods described above for rigid molds. Foundry sand core shapes define internal surfaces of the cast metal part, whereas the upper surface of the sand mold defines the outer surface configuration.

Green sand molding is the production of molded metal objects from tempered molding sand and is the most diversified molding process used to cast ferrous as well as non-ferrous metal castings. Green sand molding is favored by foundrymen because it is economical and permits both quality and quantity production, particularly for smaller castings. Castings as large as three to four tons are made successfully in green sand molds; however, as molds become larger, more time is required for the making and assembling of mold parts. Consequently, other types of molding are generally favored for the larger castings. The rapid collapsibility of green sand molds makes them much less resistant to the normal contraction of the castings while metal solidification takes place, thus minimizing problems of stresses and strains. Green sand is defined as a water-tempered molding sand mixture or composition with plasticity. A green sand mold used for casting steel usually consists of silica sand, a clay binder, and/or an organic binding agent mulled together with temper water. Other useful foundry sands include chromite, zircon and olivine sands.

One or more binders, in an amount of about 1% to about 15% by weight, mixed with the sand are essential to maintain the sand in a predetermined mold configuration. One of the most commonly employed green sand binders is clay, such as a water-swellable sodium bentonite clay or a low swellable calcium bentonite clay. The amount of the clay binder that is used together with the sand generally depends upon the particular type of sand used in the mixture and the temperature of firing. Silica sand grains expand upon heating. When the grains are too close, the molding sand moves and expands causing the castings to show defects such as "buckles" (a deformity in the casting resulting from excessive sand expansion), "rat tails" (a rough, irregular depression that appears on the surface of a casting of a minor buckle), and "scabs" (a breaking away of a portion of the molding sand when hot metal enters the mold). To overcome this harmful expansion, more clay is added to the sand mixture since the clay contracts upon firing, thereby compensating for the expansion of the silica sand grains. In green sand molding, the reproducibility of the dimensions obtained on the casting are the result of such factors as shrinkage, changes in dimensions of mold cavity, hardness of mold, stability of molding sand, mechanical alignment of flask and maintaining a fixed temperature.

Clays have been blended in the past in an attempt to achieve acceptable combination of permeabilities, green compression strengths and dry compression strengths in the molding sand mixture or composition. Toward this end, it is known to mix a sodium bentonite with a calcium bentonite or a kaolinite clay in an attempt to achieve the high dry compression strength of the sodium bentonite clay together with the high green compression strengths of the calcium bentonite clay and the low permeability of the kaolinite clay.

*See Foundry Sand Practice*by Clyde A. Sanders, 6th Edition, 1973. Also, as disclosed in this assignee's U.S. Pat. No. 5,275,114, mixtures of sodium bentonite clays obtained from different deposits provide synergism with respect to green compressive strength; hot compressive strength; dry compressive strength; flowability; surface finish; activation speed; and/or shake-out.

Other common additives for foundry sands include cellulose, cereal, or other fibrous additives included for the purpose of overcoming sand expansion defects, particularly those defects occurring on flat casting surfaces in an amount of about 0.5% to about 5% by weight of dry sand. Typical cellulose additives include wood flour and cereals such as rye flour, wheat flour, corn flour, oat hulls, rice hulls, alfalfa fines, grain chaff, flax seed pressings, corn cob flour, pulverized nut hulls, ground cotton-seed pulp after oil extraction, and the like. Cements, e.g., portland; natural cements, such as heated, ground limestone, resins and the like in amounts of about 3% to about 6 % by weight of the dry sand also can be added to foundry sand binders of the present invention.

Various other additives may be included in foundry sands, such as various blackings or other carbonaceous materials, such as graphite; pitch; charcoal; bituminous coal, or soft coal, such as seacoal; hard coal; and coke which can be used with, or as a partial clay substitute for wet coating to prevent metal penetration or bum-on; chemical agents, such as resin binders; china clay; oils, such as linseed oil and the like. These additional additives generally are included in amounts of less than about 1% by weight of the sand and, generally, in an amount of 0 to about 10% by weight total.

Western (sodium) bentonites are known to supply the required dry and hot strengths to prevent cutting, washing and eroding of the molds when metal passes over them. Western bentonite is more durable than Southern (calcium) bentonite, and requires less replacement in reused molding sand mixtures or compositions. Further, Western bentonite-bonded molding sands have a more gummy feel than Southern bonded sand mixtures when the temper water is added and mulled into sand mixtures. Western bentonite sand mixtures are said to be "tougher" and not as "brittle" as Southern bentonite-bonded molding sands prepared in the same manner. It is also known to treat calcium bentonite with a sodium carbonate treatment, a process known as peptizing, to convert the calcium bentonite to a swelling sodium bentonite. Generally the clay or clay mixture is used in the silica sand in an amount of about 1% by dry weight up to about 15% based on the total dry weight of the foundry sand composition; generally about 3% to about 10% by weight based on the dry weight of the total sand composition. It is understood in the foundry industry that by adding more clay binder to a foundry sand mixture, more water is also required. Therefore, it is often the case that by using less clay binder in a foundry sand mixture and reducing the amount of temper water added, the foundry sand mixture is just as strong as it was with a higher percentage of clay binder and water.

In addition to the above-described foundry sand additives that, upon exposure to molten metal temperatures, release gaseous volatile organic compounds (VOCs), many foundry cores and foundry molds are coated with various refractory components, binders, and chemical modifiers in the form of a coating composition containing a substantial proportion of a liquid carrier, generally water, and a suspending agent. These coating compositions are used to enhance the surface finish of the coating and reduce coating defects which occur at the sand-metal interface, but also add to the VOC emissions in the foundry.

Foundry sands, after repeated use, accumulate a substantial amount of condensed VOCs that are emitted to the atmosphere upon repeated uses, or the gaseous emissions are collected in expensive gas treating apparatus, such as foundry stack scrubbing apparatus. A number of mold and core formulations of commercial foundries were investigated to determine the sand mold/core composition analyzing for benzene emissions and other extractable organic matter (EOM) contained in the corresponding mold/core compositions. It was found that the majority of the mold/core sand compositions emitted benzene, when heated above the benzene vaporization temperature of about 176° F. at 1 atmosphere (760 mm Hg) pressure, e.g., heated to 1800° F. at 1 atmosphere (760 mm Hg) pressure, in an amount greater than 0.1 milligrams of benzene per gram of sand compositions (mg/g). Also, the majority of the commercial foundry sand/core compositions contained EOMs (total VOCs @ 1800° F. and 1 atmosphere pressure contained in the composition) in an amount of at least 0.5 mg/g, usually in the range of 0.5–1 mg/g. All the commercial foundry mold/core sand compositions tested contained benzene in an amount greater than 0.075 mg/g and EOMs in an amount of at least 0.3 mg/g, as shown in FIG. 1, with the exception of foundries that used foundry sands containing the activated carbon and/or carbon/graphite and humic-containing ores disclosed in this Assignee's U.S. patent application Ser. Nos. 08/668,245 filed Jun. 21, 1996 and 08/759,087 filed Nov. 29, 1996, both applications hereby incorporated by reference. Further, to achieve the full advantage of the present invention, it has been found that the carbon source (carbon and/or graphite), combined with the humic-containing ore, should have a volatilizable organic content at 1800° F. and 1 atmosphere pressure less than about 10 mg/g, preferably less than about 1 mg/g of carbon source, more preferably less than about 0.5 mg/g, most preferably less than about 0.3 mg/g. The foundry sands of the present invention can be analyzed and maintained to contain benzene in an amount less than about 0.1 mg/g, preferably less than about 0.05 mg/g, more preferably less than about 0.03 mg/g, and total VOCs at 1800° F. and 1 atmosphere pressure in an amount less than about 0.5 mg/g, preferably less than about 0.3 mg/g, and more preferably less than about 0.2 mg/g, by periodic sand analysis and sand treatment, such as addition of activated carbon or activated graphite, or sand replacement or hydrocarbon removal or oxidation.

SUMMARY OF THE INVENTION

In brief, the present invention is directed to a method of determining when a foundry molding sand and/or foundry core sand composition has accumulated enough hydrocarbons such that the foundry will emit sufficient VOCs to be detrimental to the atmosphere; and/or to a method of maintaining foundry molding sand and/or a foundry core sand compositions relatively free of volatile organic hydrocarbons (at 1800° F. and 760 mm Hg pressure) by periodically analyzing the sand mold and/or sand core compositions for benzene and/or total volatilizable organic compounds (VOCs), at 1800° F. and 760 mm Hg pressure. If the sand composition is determined by analysis, e.g., by volatilizing the hydrocarbons, e.g., at 1800° F. and passing the volatilized material through a gas chromatograph, or by thermogravimetric analysis, to contain more than a desired amount of VOCs, and/or more than a desired amount of benzene, e.g., more than about 0.1 mg/g benzene or more than about 0.05 mg/g benzene; and/or more than about 0.5 mg/g total VOCs, or more than about 0.3 mg/g or about 0.2 mg/g total VOCs, by measuring all organic hydrocarbons that volatilize at 1800° F. and 1 atmosphere (760 mm Hg) pressure, the sand composition then can be treated, such as by sand replacement; for hydrocarbon removal or hydrocarbon oxidation, such as by solvent extraction, or oxidation, e.g., by contact with $\mathbf{0}_3$ in water solution; or by adding activated carbon or generating activated carbon in-situ with low VOC carbon and/or graphite, including industrial carbon, and a humic-containing ore, as disclosed in my parent patent applications. The treated sand then is reused to form a foundry sand mold and/or sand core for reduced emissions.

Accordingly, one aspect of the present invention is to provide a method of foundry sand molding or casting that provides accurate information regarding the tendency of the sand to emit VOCs.

Another aspect of the present invention is to provide a method of foundry sand molding or casting including a sand analysis step; and a subsequent sand treatment step that changes the sand composition such that the sand, when reused to form another foundry sand mold or foundry sand core, emits acceptable amounts of gaseous hydrocarbons.

Still another aspect of the present invention is to provide a method of foundry sand molding that includes a sand analysis step that provides information regarding a quantity of accumulated hydrocarbons; and further including a sand treatment step, such as adding activated carbon or activated graphite to the sand, or a treatment step such as hydrocarbon oxidation or hydrocarbon removal, such as by solvent extraction.

The above and other aspects and advantages of the present invention will become more apparent from the following detailed description of the preferred embodiments, taken in conjunction with the drawings.

DETAILED DESCRIPTION OF THE PREFERRED EMBODIMENTS

Figure 1:
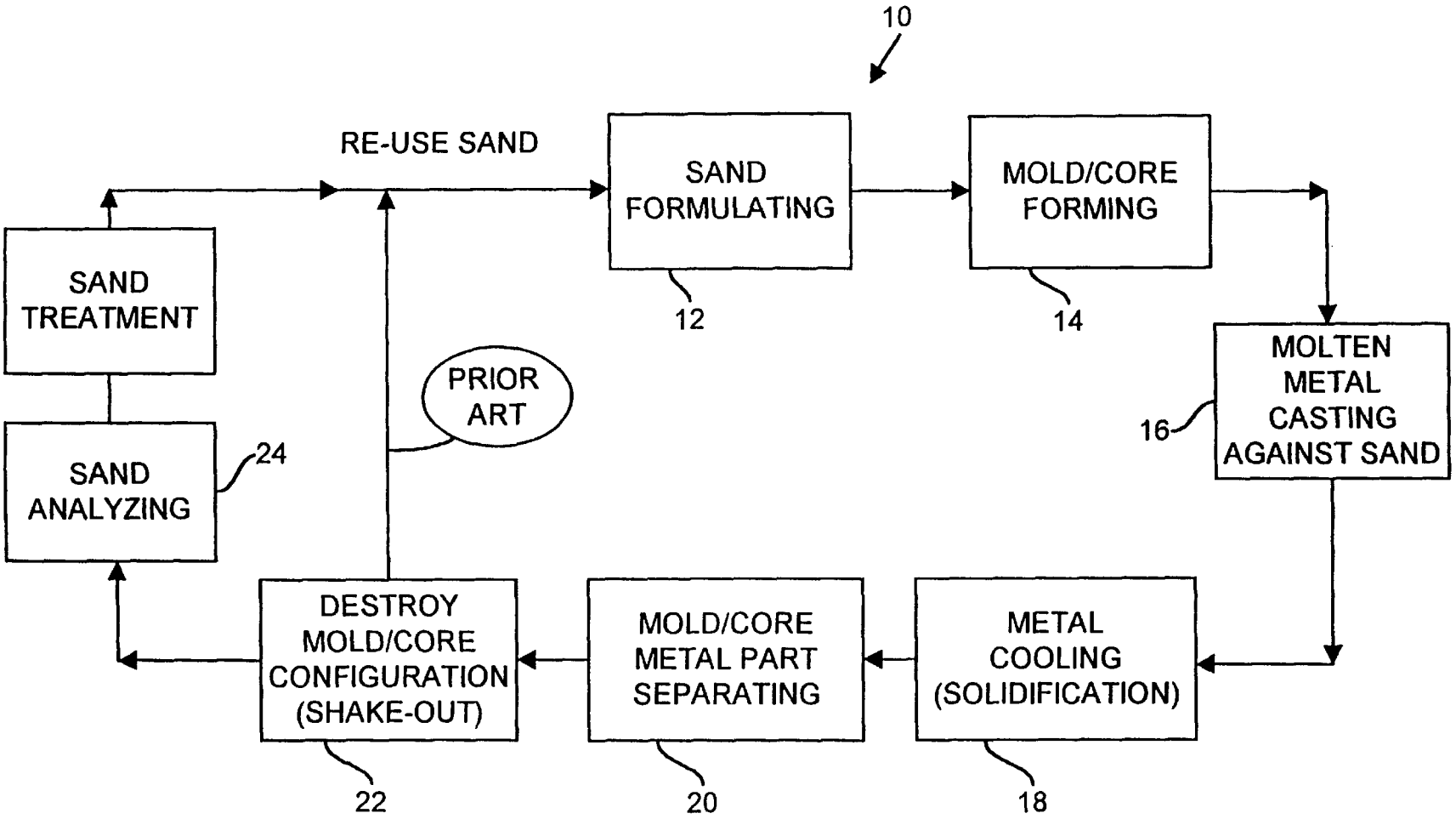
FIG. 1 is a schematic diagram of the foundry sand molding process of the present invention, also showing the process of the prior art without sand analysis or treatment.

Volatile organic compounds (VOCs) are generated from many of the above-mentioned sand additives in foundry sand molding compositions, as well as foundry sand core compositions, at the high temperatures of the molten metals that contact sand mold and sand core compositions. Others have recognized this environmental and safety problem by analysis of gases emitted during the foundry molding or casting process, and some foundries use expensive gas scrubbing apparatus in order to avoid emitting such VOCs to the atmosphere. Most present governmental regulations, however, do not require the employment of such scrubbing apparatus and, therefore, most foundry operations presently emit a substantial amount of VOCs to the atmosphere. Solutions to the VOC emissions in a foundry operation are provided in my parent applications wherein it is disclosed that activated carbon and/or activated graphite added to the foundry molding sand compositions and/or core compositions will absorb the VOCs and the extractable organic matter generated during the molten metal casting process in a foundry operation such that less VOCs (volatile organic compounds) are emitted to the atmosphere. The activated carbon and/or activated graphite can be included in the foundry sand composition as such or can be generated in-situ by adding low VOC carbon and/or low VOC graphite together with humic acid or a humic-containing ore (a humic acid-containing or humic acid salt-containing ore) so that the carbon and/or graphite is activated in-situ at the molten metal temperatures contacting the foundry sand.

One of the most surprising aspects of the use of activated carbon or activated graphite as a foundry sand additive is that the VOCs that are absorbed by the activated carbon or activated graphite sand additive never accumulate in the activated carbon or activated graphite to an extent that eventually such VOCs will be driven off of the foundry sand composition into the atmosphere. Whereas prior art foundry molding sand compositions and foundry core sand compositions accumulate substantial amounts of VOCs such that, during the foundry molding operations, such hydrocarbons are driven off to the atmosphere, activated carbon and/or activated graphite will continue to absorb such hydrocarbons without emitting the hydrocarbons to the atmosphere. Apparently, it is theorized that, the activated carbon and/or activated graphite will release such hydrocarbons at a point during the foundry molding operation where these hydrocarbon gases are destroyed or reacted or oxidized to $CO_2$, $H_2$, elemental carbon or gaseous compounds, that are environmentally inert, by the high temperatures of the molten metal from atmospheric $O_2$ within the mold and from the molten metal gases. Prior art foundry sand compositions, however, release such undesirable hydrocarbon gases to the atmosphere.

Accordingly, an accurate process is needed to monitor and analyze foundry mold sands and foundry core sands to determine when these sand compositions should be treated, e.g., by removal of a majority of the accumulated, volatilizable hydrocarbons; oxidation of these volatilizable hydrocarbons; or incorporation of activated carbon and/or activated graphite into the foundry sand (or formation thereof in-situ) to avoid emitting hydrocarbons to the atmosphere. In accordance with the present invention, it has been found that analysis of the foundry sand itself, rather than analysis of the gases emitted during the foundry casting process, provides a very accurate measurement of VOCs and other extractable organic matter contained in the foundry sand, when analyzed during any stage of the foundry operation.

Turning now to the drawings, FIG. 1 is a schematic diagram of a foundry molding operation schematically showing the sand analysis and sand treating operations of the present invention. As shown in FIG. 1, the foundry molding operation, generally designated 10, in accordance with the present invention, includes a sand formulating step 12 where a foundry sand such as silica sand, olivine sand, zircon sand, chromite sand, carbon particles, coke particles and/or a roasted carbon sand is combined with one or more binders, such as sodium bentonite clay, and other additives.

Other common additives for foundry sands include cellulose, cereal, or other fibrous additives included for the purpose of overcoming sand expansion defects, particularly those defects occurring on flat casting surfaces, in an amount of about 0.5% to about 5% by weight of dry sand. Typical cellulose additives include wood flour and cereals such as rye flour, wheat flour, corn flour, oat hulls, rice hulls, alfalfa fines, grain chaff, flax seed pressings, corn cob flour, pulverized nut hulls, ground cotton-seed pulp after oil extraction, and the like. Cements, e.g., portland; natural cements, such as heated, ground limestone, resins and the like in amounts of about 3% to about 6% by weight of the dry sand also can be added to foundry sand binders.

Various other additives may be included in foundry sands, such as various blackings or other carbonaceous materials, such as graphite; pitch; charcoal; bituminous coal, or soft coal, such as seacoal; hard coal; and coke which can be used with, or as a partial clay substitute for wet coating to prevent metal penetration or burn-on; chemical agents, such as resin binders; china clay; oils, such as linseed oil and the like. These additional additives generally are included in amounts of less than about 1% by weight of the sand and, generally, in an amount of 0 to about 10% by weight total.

When the sand is properly formulated in formulating step 12, the mold and cores made from the sand composition are formed into a desired configuration for receiving molten metal, in mold/core forming step 14, to provide an external configuration and, optionally, internal void volume for receiving molten metal in the configuration of a finished part. Molten metal then is poured into the foundry mold and fills the void volume between the foundry mold configuration and the outer surface of the core configuration, in molten metal casting step 16, for solidification of the molten metal into a desired three dimensional configuration in metal cooling or solidification step 18. The mold/core metal part separating step 20 and shake-out step 22 then can be performed as separate steps, or may be combined as a single step wherein the mold and core, for example, may be vibrated to separate the metal part from the mold and core and for recovery of the sand composition. For example, the entire mold and core and metal part may be dropped into a vibrating drum having apertures for receiving the sand composition and retaining the metal part so that the sand composition can be reused to form another mold and core for casting another metal part.

Figure 2:
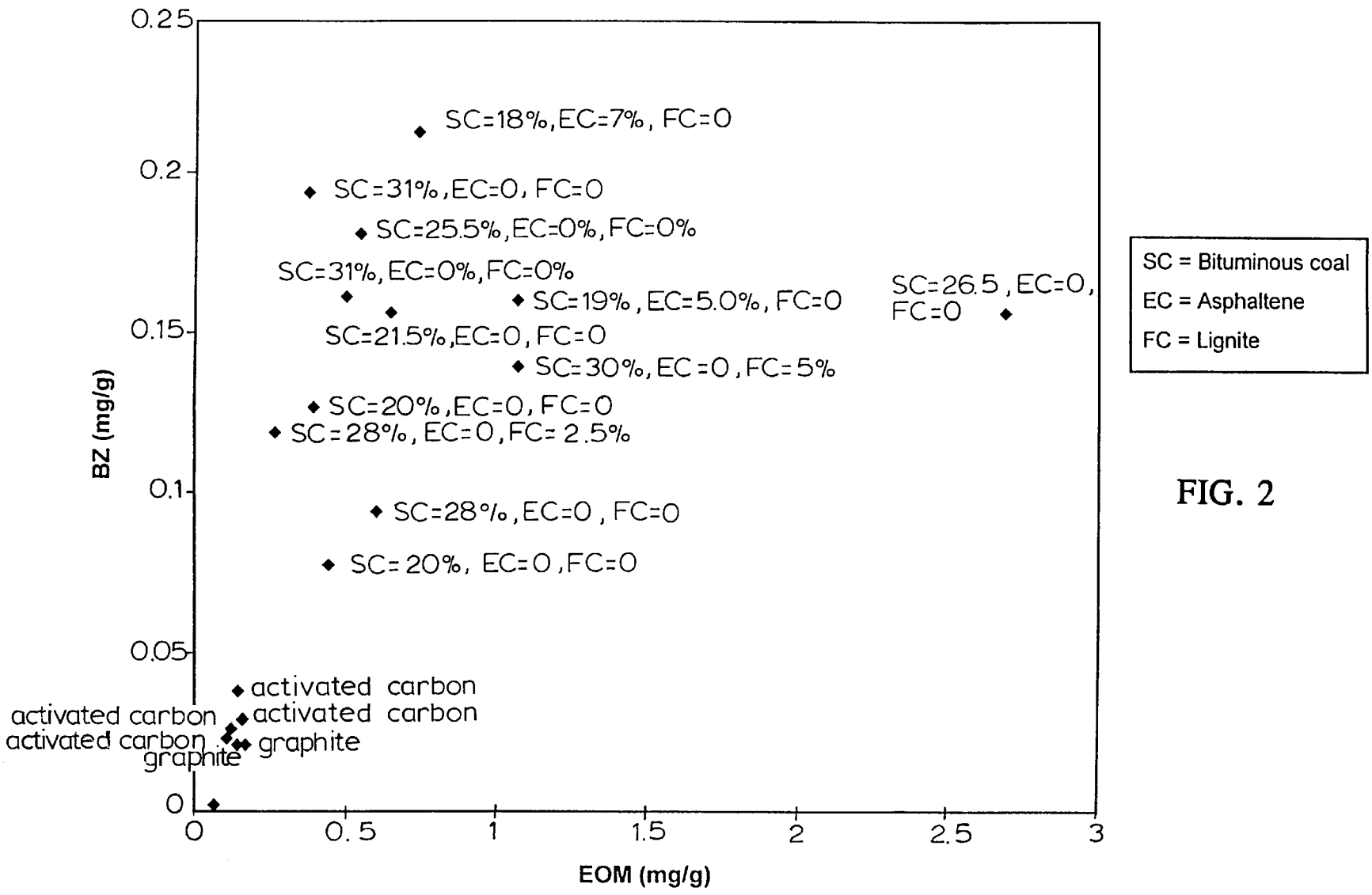
FIG. 2 is a graph of benzene (BZ) and extractable organic matter (EOM) contained in a number of commercial foundry molding sand compositions, as well as molding sands containing activated carbon or activated graphite.

In reusing the sand composition recovered from the shake-out step 22, it may be necessary to add some additional sand and/or additives lost during the shake-out process in order to maintain a consistent foundry sand composition. The above-described process is typical of foundry procedures and examples of typical prior art foundry sand mold and core compositions that were analyzed for VOCs and EOMs, are shown in FIG. 2 and in the following Examples 1–19:

EXAMPLE 1

44.75% DC1 Sodium Bentonite
27.00% DC6 Calcium Bentonite
28.00% Coal (Seacoal)
0.25% Soda Ash

EXAMPLE 2

47.625% DC1 Sodium Bentonite
29.250% DC6 Calcium Bentonite
23.000% Coal (Seacoal)
0.125% Soda Ash

EXAMPLE 3

95.75% DC6 Calcium Bentonite
2.00% Oxidized Lignite (FLOCARB®)
1.00% Cereal
0.25% Soda Ash
1.00% Cellulose (Cellflo)

EXAMPLE 4

77.00% DC1 Sodium Bentonite
15.00% DC6 Calcium Bentonite
5.00% Coal (Seacoal)
2.00% Oxidized Lignite (FLOCARB®)
1.00% Cellulose (Cellflo)

EXAMPLE 5

18.50% DC1 Sodium Bentonite
18.50% DC2 Sodium Bentonite
37.00% DC6 Calcium Bentonite
25.50% Coal (Seacoal)
0.50% Soda Ash

EXAMPLE 6

48.00% DC2 Sodium Bentonite
24.50% DC6 Calcium Bentonite
24.00% Coal (Seacoal)
3.00% Carbon (Ecolocarb)
0.50% Soda Ash

EXAMPLE 7

70.00% DC1 Sodium Bentonite
16.00% DC6 Calcium Bentonite
12.00% Coal (Seacoal)
2.00% Red Iron Oxide

EXAMPLE 8

38.00% DC2 Sodium Bentonite
36.00% DC6 Calcium Bentonite
23.00% Coal (Seacoal)
3.00% Carbon (Ecolocarb)

EXAMPLE 9

44.00% DC1 Sodium Bentonite
44.00% DC6 Calcium Bentonite
12.00% Coal (Seacoal)

EXAMPLE 10

74.00% DC1 Sodium Bentonite
21.50% Coal (Seacoal)
4.50% Cellulose (Cellflo)

EXAMPLE 11

59.50% DC2 Sodium Bentointe
12.50% DC6 Calcium Bentonite
12.00% Coal (Seacoal)
14.50% Oxidized Lignite (FLOCARB®)
1.50% Cereal

EXAMPLE 12

10.00% DC1 Sodium Bentonite
60.00% DC6 Calcium Bentonite
18.00% Coal (Seacoal)
5.00% Cellulose (Cellflo)
7.00% Carbon (Ecolocarb)

EXAMPLE 13

51.00% DC2 Sodium Bentonite
15.00% DC6 Calcium Bentonite
28.00% Coal (Seacoal)
2.50% Oxidized Lignite (FLOCARB®)
2.50% Cellulose (Cellflo)
1.00% Colloidex Starch (Dextrine)

EXAMPLE 14

55.00% DC1 Sodium Bentonite
45.00% DC6 Calcium Bentonite

EXAMPLE 15

70.00% DC2 Sodium Bentonite
10.00% DC6 Calcium Bentonite
20.00% Coal (Seacoal)

EXAMPLE 16

31.00% Coal (Seacoal)
51.75% DC3 Sodium Bentonite
17.25% DC6 Calcium Bentonite

EXAMPLE 17

34.00% Coal (Seacoal) 54.68% DC3 Sodium Bentonite
11.16% DC6 Calcium Bentonite
0.16% Cereal

EXAMPLE 18

22.50% DC6 Calcium Bentonite
53.00% DC3 Sodium Bentonite
19.00% Coal (Seacoal)
5.00% Carbon (Ecolocarb)
0.50% Soda Ash

EXAMPLE 19

30.00% Coal (Seacoal)
55.00% DC3 Sodium Bentonite
10.00% DC6 Calcium Bentonite
5.00% Oxidized Lignite (FLOCARB®)

When the foundry sand was formulated to include activated carbon and/or a combination of a humic-containing ore, such as lignite, oxidized lignite, or leonardite and low VOC carbon or graphite, as shown in Example 20, the benzene and total VOCs contained in the foundry sand after numerous reuses were found to be substantially less, as shown in FIG. 2.

EXAMPLE 20

20.00% DC6 Calcium Bentonite
54.00% Coal (Seacoal)
21.60% Oxidized Lignite (FLOCARB®)
2.00% Cereal
1.20% Activated carbon
1.20% Leonardite/graphite In accordance with the present invention, as shown in FIG. 1, instead of the sand composition being conveyed directly from the shake-out process 22 back to the sand formulating step 12 during the sand recycling process, a representative sand composition sample is taken, periodically, (not necessarily after every part is molded) e.g., once every 1,000 to 2,000 castings against the sand composition, and analyzed for one or more volatile organic compounds (VOCs), e.g., benzene, and/or total hydrocarbons volatilizable at 1800° F. (EOMs) in sand analyzing step 24. A number of sand analyzing processes can be used to determine the benzene content, and total VOCs at any given temperature, e.g., 1800° F., such as a thermogravimetric analysis, whereby the sand sample is subjected to a given temperature (such as the molten metal temperature) to volatilize all organic compounds that will volatilize at the temperature that the sand composition is subjected to, and the remaining sand material then weighed to determine the amount of VOCs that have been volatilized and thereby removed from the sand composition.

Another method of sand analysis that may be used instead of thermogravimetric analysis, or in addition to thermogravimetric analysis, is to extract the hydrocarbons from the sand sample with a solvent capable of dissolving hydrocarbons, e.g., methylene chloride, such as in a Sohxlet extractor and, thereafter, either dry and weigh the remaining sand composition to determine the amount of extractable organic matter, or inject the extract into a gas chromatograph to determine the composition of the organic matter extracted as well as the relative quantity of the various hydrocarbons.

If extracting the hydrocarbons from the sand sample, any number of extraction solvents may be used, particularly chlorinated organic solvents such as methylene chloride; carbon tetrachloride; trichloroethylene; 1,1,1,-trichloroethane; 1,1,2,-trichloroethane; ethylene dichloride; propylene dichloride; perchloroethylene; monochlorobenzene; trichlorobenzene orthodichlorobenzene; dichloroethyl ether; dichloroisopropyl ether; and mixtures thereof. Aliphatic organic solvents can also be used, such as hexane; heptane; kerosene; mineral spirits; pentane; stoddard solvent; acetone; diethyl ketone; diacetone alcohol; diisobutyl ketone; dimethyl formamide; ethyl amyl ketone; an aliphatic alcohol; and mixtures thereof. Aromatic solvents also are suitable for hydrocarbon extraction, such as benzene; toluene; xylene; naphtha; and mixtures thereof.

Methylene chloride is the preferred extraction solvent for use in determining the extractable organic matter in the sand sample, and/or for hydrocarbon removed by extraction, and it is preferred not to use the aromatic solvents such as benzene, toluene, xylene and/or naphtha so that the extraction solvent does not become part of the environmental problem that the present invention is intended to alleviate. Any other solvent known to dissolve the hydrocarbons that are found to accumulate in foundry sands from a foundry molding operation also are useful in accordance with the principles of the present invention. If the foundry molding sands and/or foundry core sands are found to contain benzene in an amount greater than about 0.05 mg/g, and particularly if found in an amount greater than about 0.075 mg/g or 0.1 mg/g, the sand should be treated such as by sand replacement, hydrocarbon removal, such as by thermal extraction, solvent extraction, or hydrocarbon oxidation, or addition of activated carbon and/or activated graphite to the sand composition. Similarly, if the total VOCs at 1800° F. and 1 atmosphere pressure found by extraction of the sand sample with a suitable hydrocarbon-dissolving solvent, such as methylene chloride or found by thermal extraction or thermogravimetric analysis (or other technique), is found to be in excess of about 0.2 mg/g, or 0.3 mg/g, particularly if the total VOCS at 1800° F. are found to be in excess of about 0.5 mg/g, the sand composition should be treated.

What is claimed is:

1. A method of casting molten metal against a foundry sand mold composition to form a metal part comprising:

mixing the foundry sand with a sand binder and a sand additive containing an organic component that vaporizes at or below the temperature of the metal to form a foundry sand mold composition;

pouring said molten metal into the mold in contact with the foundry sand mold composition;

allowing the molten metal to cool and solidify while in contact with the foundry sand mold composition, thus forming said metal part;

separating the solidified metal part from the foundry sand mold composition;

analyzing the foundry sand mold composition for one or more hydrocarbons that volatilize at or below the temperature of the molten metal;

treating the foundry sand mold composition to reduce volatile hydrocarbon emissions and form a reduced-emission foundry sand mold composition;

reusing the reduced-emission foundry sand mold composition to form another foundry sand mold composition; and pouring molten metal into the mold in contact with the reduced-emission foundry sand mold composition.

2. The method of claim 1, wherein the treating step includes removing a portion of the hydrocarbons to form said reduced-emission foundry sand mold composition.

3. The method of claim 1, wherein the foundry sand mold composition is analyzed for cyclic hydrocarbons.

4. The method of claim 1, wherein the foundry sand mold composition is analyzed for benzene.

5. The method of claim 1, wherein the foundry sand mold composition is analyzed for all organic compounds that vaporize at or below the temperature of the molten metal.

6. The method of claim 1, wherein the foundry sand mold composition is analyzed for all organic compounds that vaporize at or below 1800° F. at 760 mm Hg pressure.

7. The method of claim 1, wherein a sample of the foundry sand mold composition is analyzed by heating the foundry sand mold composition to volatilize hydrocarbons and then weighing the foundry sand mold composition to determine the quantity of volatilized hydrocarbons removed from the foundry sand mold composition.

8. The method of claim 2, wherein hydrocarbons contained in the foundry sand composition are removed by solvent extraction.

9. The method of claim 8, wherein hydrocarbons are removed by extraction with a solvent selected from the group consisting of chlorinated organic solvents, aliphatic organic solvents, and aromatic organic solvents.

10. The method of claim 8, wherein the solvent is a chlorinated organic solvent selected from the group consisting of methylene chloride; carbon tetrachloride; trichloroethylene; 1,1,1,-trichloroethane; 1,1,2,-trichloroethane; ethylene dichloride; propylene dichloride; perchloroethylene; monochlorobenzene; trichlorobenzene orthodichlorobenzene; dichloroethyl ether; dichloroisopropyl ether; and mixtures thereof.

11. The method of claim 8, wherein the solvent is an aliphatic organic solvent selected from the group consisting of hexane; heptane; kerosene; mineral spits; pentane; stoddard solvent; acetone; diethyl ketone; diacetone alcohol; diisobutyl ketone; dimethyl formamide; ethyl amyl ketone; an aliphatic alcohol; and mixtures thereof.

12. The method of claim 8, wherein the solvent is an aromatic solvent selected from the group consisting of benzene; toluene; xylene; naphtha; and mixtures thereof.

13. An improved method of casting molten metal against a foundry sand mold composition to form a metal part including the steps of mixing the foundry sand with a sand binder and a sand additive containing an organic component that vaporizes at or below the temperature of the molten metal to form a foundry sand mold composition; pouring said molten metal into the mold in contact with the foundry sand mold composition; allowing the molten metal to cool and solidify while in contact with the foundry sand mold composition, thus forming said metal part; separating the solidified metal part from the foundry sand mold composition and reusing the foundry sand mold composition to form another foundry sand mold composition; the improvement comprising:

analyzing the foundry sand mold composition for one or more volatilizable hydrocarbons; and treating the foundry sand mold composition to reduce volatile hydrocarbon emissions and form a reduced-emission foundry sand mold composition.

14. The method of claim 13, wherein the treating step includes removing a portion of the hydrocarbons that volatilize at or below the temperature of the molten metal which are contained in the foundry sand mold composition.

15. The method of claim 14, wherein the foundry sand mold composition is analyzed for benzene.

16. The method of claim 14, wherein the foundry sand mold composition is analyzed for all organic compounds that vaporize at or below the temperature of the molten metal.

17. The method of claim 14, wherein the foundry sand mold composition is analyzed for all organic compounds that vaporize at or below 1800° F. at 760 mm Hg pressure.

18. The method of claim 13, wherein a sample of the foundry sand mold composition is analyzed by thermogravimetric analysis.

19. The method of claim 14, wherein hydrocarbons contained in the foundry sand mold composition are removed by solvent extraction.

20. The method of claim 19, wherein a majority of the hydrocarbons are removed by extraction with a solvent selected from the group consisting of chlorinated organic solvents, aliphatic organic solvents, and aromatic organic solvents.

* * * * *